US012715652B2

(12) United States Patent
Wong et al.

(10) Patent No.: US 12,715,652 B2
(45) Date of Patent: Aug. 25, 2026

(54) STORAGE CONTAINER

(71) Applicant: Lifestyle Dreams Ltd., Kwun Tong (CN)

(72) Inventors: Wai Hang Wong, Kwun Tong (CN); Pieter Jules J. Van Lancker, Tielt (BE)

(73) Assignee: Lifestyle Dreams Ltd., Kwun Tong (HK)

( * ) Notice: Subject to any disclaimer, the term of this patent is extended or adjusted under 35 U.S.C. 154(b) by 27 days.

(21) Appl. No.: 18/395,734

(22) Filed: Dec. 25, 2023

(65) Prior Publication Data

US 2024/0208692 A1 Jun. 27, 2024

Related U.S. Application Data

(60) Provisional application No. 63/435,546, filed on Dec. 27, 2022.

(51) Int. Cl.
*B65D 21/02* (2006.01)

(52) U.S. Cl.
CPC ..... *B65D 21/0234* (2013.01); *B65D 21/0224* (2013.01)

(58) Field of Classification Search
CPC ..... B65D 21/0224; B65D 21/0234; B65D 21/0228; B25H 3/021
USPC ..... 220/23.83, 4.26
See application file for complete search history.

(56) References Cited

U.S. PATENT DOCUMENTS

| | | | | |
|---|---|---|---|---|
| 3,208,620 | A * | 9/1965 | Herdering | B65D 43/0212 220/4.24 |
| 3,981,409 | A * | 9/1976 | Flanders | B65D 45/16 220/4.07 |
| 6,105,781 | A * | 8/2000 | Ejima | H01L 21/67393 220/806 |
| 2010/0200438 | A1 | 8/2010 | Davies | |
| 2011/0163092 | A1 | 7/2011 | Hacsi | |
| 2015/0284138 | A1 | 10/2015 | Lane et al. | |
| 2016/0073811 | A1 | 3/2016 | Bell et al. | |
| 2017/0021966 | A1 | 1/2017 | Parikh et al. | |

(Continued)

FOREIGN PATENT DOCUMENTS

| | | | |
|---|---|---|---|
| CN | 103818610 | A | 5/2014 |
| CN | 212149785 | * | 12/2020 |
| FR | 2201045 | A2 | 4/1974 |

(Continued)

*Primary Examiner* — Orlando E Aviles
*Assistant Examiner* — Sanjidul Islam
(74) *Attorney, Agent, or Firm* — Puget Sound Patents; Dwayne E Rogge

(57) ABSTRACT

A storage container in one example having a first vessel with a first perimeter edge defining an opening bounding a first containing basin; a second vessel having a second perimeter edge defining an opening bounding a second containing basin; a sealing ring having a rigid frame; the sealing ring having a perimeter seal on the rigid frame, the perimeter seal in continuous contact with and removably sealed to the first perimeter edge of the first vessel; the perimeter seal continuous contact with and removably sealed to the second perimeter edge of the second vessel; a first latching mechanism mechanically connecting the first vessel to the sealing ring; and a second latching mechanism mechanically connecting the second vessel to the sealing ring.

20 Claims, 10 Drawing Sheets

(56) References Cited

U.S. PATENT DOCUMENTS

2023/0381945 A1* 11/2023 Tsai ..... B25H 3/023

FOREIGN PATENT DOCUMENTS

| | | | |
|---|---|---|---|
| FR | 2261938 | A1 | 9/1975 |
| KR | 20120102380 | A | 9/2012 |
| TW | 112150839 | | 12/2023 |
| WO | PCTCN2023142326 | | 12/2023 |

* cited by examiner

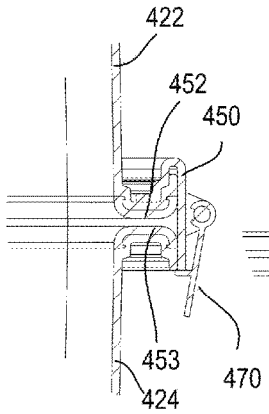
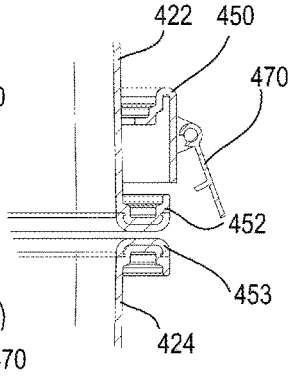
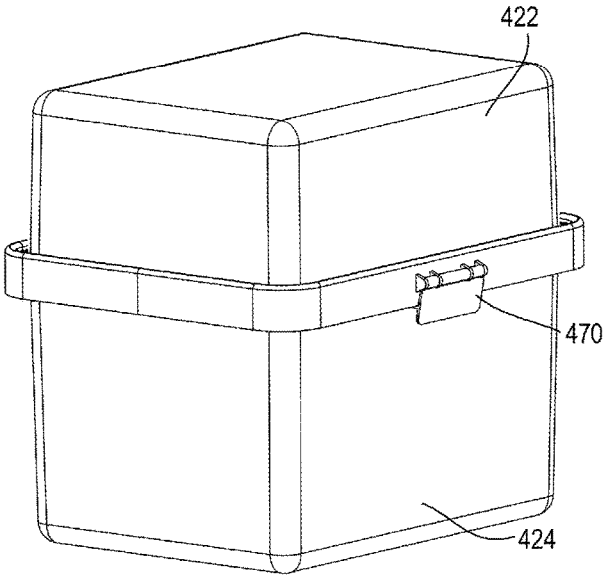
Fig. 17 Fig. 18 Fig. 19
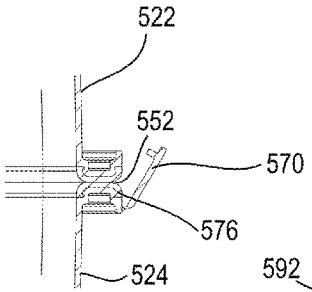
Fig. 20
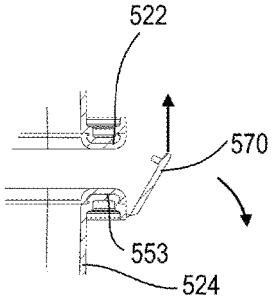
Fig. 21
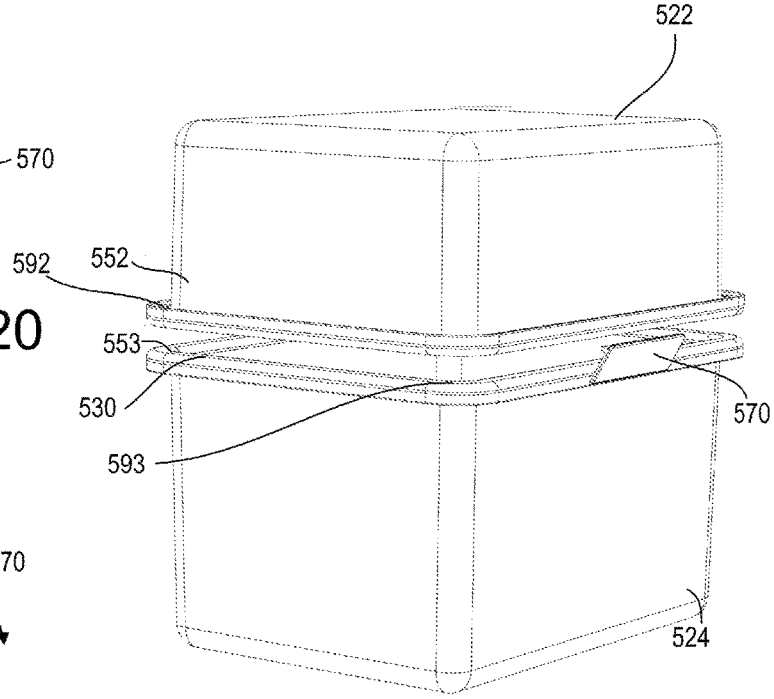
Fig. 22

STORAGE CONTAINER

This claims priority benefit of U.S. Provisional Ser. No. 63/435,546 filed Dec. 27, 2022, incorporated herein by reference.

BACKGROUND OF THE DISCLOSURE

Field of the Disclosure

This disclosure relates to the field of storage container systems having a first vessel or base and a separable second vessel or lid to enclose the container and in combination form a sealed container.

BRIEF SUMMARY OF THE DISCLOSURE

Disclosed herein is a storage container system comprising a first vessel having a first perimeter edge defining an opening; and a second vessel having a second perimeter edge defining an opening. Each of the first vessel and the second vessel are configured to contain a volume of food or other substance.

The storage container system of one example also comprises a sealing ring comprising a rigid frame. The sealing ring having a perimeter seal sealed to each of the first perimeter edge and the second perimeter edge. This sealing ring and the attached perimeter seal to the perimeter edges of the first vessel and the second vessel and in combination form a storage container. Also disclosed is a first latching mechanism mechanically connecting the first vessel to the sealing ring; and a second latching mechanism mechanically connecting the second vessel to the sealing ring. These latching mechanisms secure each of the first vessel and the second vessel to the sealing ring to form the storage container and keep the or other substance within. These latching mechanisms also press each of the first vessel and the second vessel to the sealing ring. Thus, the integrity of the seal is maintained so that fluids do not enter or exit the storage container when not desired.

The storage container system may be arranged wherein the first perimeter edge of the first vessel and the second perimeter edge of the second vessel are substantially identical or may be substantially mirror images. In the examples shown, the perimeter edge of the first vessel and the second perimeter edge of the second vessel are substantially identical and are substantially mirror images of each other.

The storage container system may be arranged wherein the sealing ring does not substantially obstruct passage between the first vessel and the second vessel.

The storage container system may be arranged wherein the perimeter seal is removable from the rigid frame.

The storage container system may be arranged wherein the perimeter seal is a malleable seal.

The storage container system may be arranged wherein the perimeter seal comprises a first perimeter seal on a first side of the rigid frame, the first perimeter seal in continuous contact with and removably sealed to the first perimeter edge of the first vessel; and a second perimeter seal on a second side of the rigid frame opposing the first side, the second perimeter seal in continuous contact with and removably sealed to the second perimeter edge of the second vessel.

A storage container system is also disclosed, for use with or other substances.

BRIEF DESCRIPTION OF THE SEVERAL VIEWS OF THE DRAWINGS

FIG. 17 is a cross-sectional view of the closed container example shown in FIG. 19.

FIG. 18 is a cross-sectional view of the example shown in FIG. 19 with the seal ring component partially removed.

FIG. 19 is another example of the disclosed storage container.

FIG. 20 is a cross-sectional view of the closed container example shown in FIG. 22.

FIG. 21 is a cross-sectional view of the container example shown in

FIG. 22 shown with the container opened.

FIG. 22 is another example of the disclosed storage container.

DETAILED DESCRIPTION OF THE DISCLOSURE

In the field of storage containers, such containers often comprise a vessel having one or more openings with a rim around each opening. The vessel defining a volume into which is placed the item(s) to be contained. A lid commonly covers such an opening when the container is closed to keep items such as food and other substances in, and the sealed combination also functions to keep other foods and materials such as air, water, humidity, and contaminates out of the container. Such lids are often connected to the vessel by a hinge to remain in place relative to the vessel and/or clasp or latch to remain closed when moved about. Thus, the container and the lid of many prior known combinations have a perimeter edge configured to engage the cooperating perimeter edge of the associated lid. Thus, combinations are limited to particular vessel/lid combinations, with vessel/vessel combinations not being possible.

One common use of the storage containers disclosed herein is for food, however it is to be understood that the containers may be used for other materials, substances including solids, liquids etc. as well.

One concern with many known prior art containers is that with a set of vessels having dedicated lids, the volume of the container is dictated solely by the volume of the vessel, the lid commonly having no appreciable volume. Thus, with such lids, only one volume may be achieved by a particular vessel.

Figure 1:
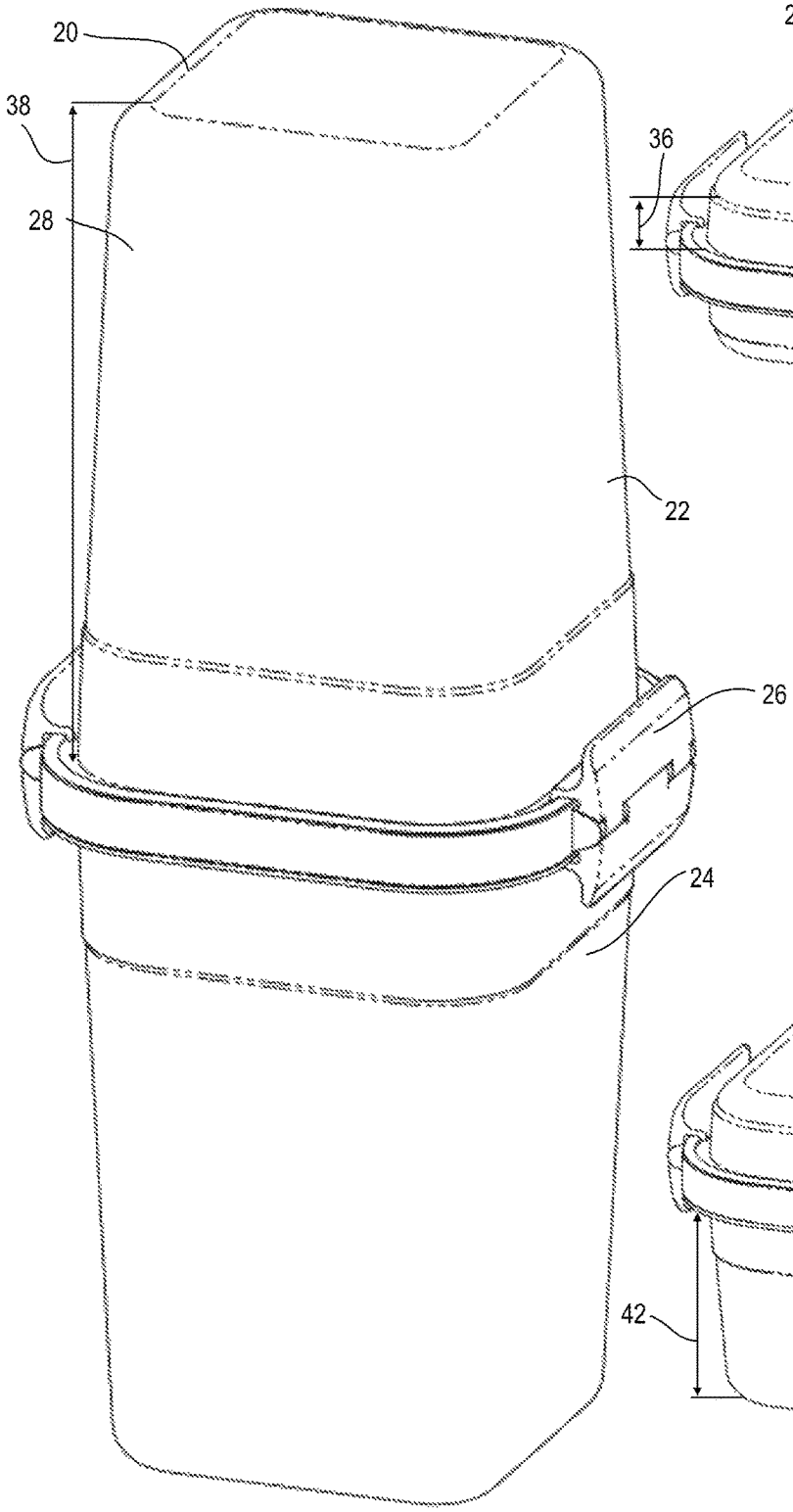
FIG. 1 is a front perspective view of one example of the disclosed storage container. Broken lines of each figure showing contour lines of a rounded edge.

What is disclosed herein is a storage container system 20 as shown in the drawings combining a first vessel 22 and a second vessel 24 with a sealing ring 26 between them as a single container. The volumes of each of the first vessel and second vessel may be selected in various combinations as desired to form one container 28 volume as shown in FIG. 1.

To allow for combination of various vessels 22/24/etc. in one example, each of the first vessel 22 and the second vessel 24 of various sizes have substantially identical (or mirror image) perimeter edges 30 (FIG. 5) such that a sealing ring 26 therebetween connects the first vessel 22 to the second vessel 24 and seals the container 28. The sealing ring 26 of one example allows substantially unrestricted passage between the two attached storage vessels. The container 28 thus having a volume equal to the combined volume of the first vessel 22, second vessel 24, combined with a volume due to the thickness of the sealing ring 26 between the adjacent perimeter edges of the first vessel 22, second vessel 24.

Figure 2:
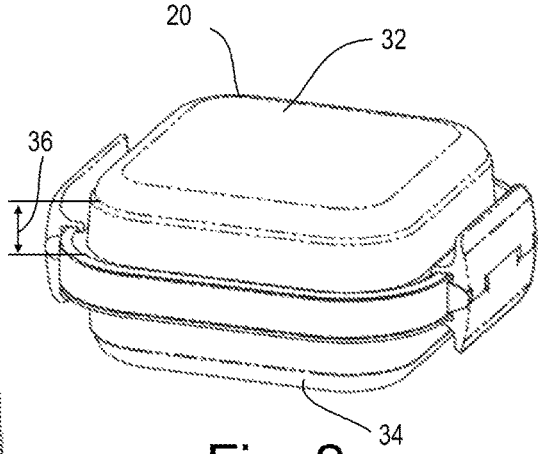
FIG. 2 is a front perspective view of another example of the disclosed storage container.

In FIG. 2 is shown one example of a storage container system 20 where a third vessel 32 and fourth vessel 34 each have a perimeter edge (30) which is effectively identical to the perimeter edges 30 of the first vessel 22 and second vessel 24. However, the depth 36 of the third vessel 32 and depth of the fourth vessel 34 are substantially less than the depth 38 of the first vessel 22 and the depth of the second vessel 24. Thus, the container formed in this example will have a substantially lesser volume than the example shown in FIG. 1 formed by the first vessel 22 combined with the second vessel 24 and will take up much less storage space. The depth 36 in one example may be substantially 50%, 33%, 25%, 10% or a range therebetween the length and/or width of the sealing ring. The depth 38 of the example shown in FIG. 1 may be substantially 100%, 200%, 300%, 400% or a range therebetween the length and/or width of the sealing ring. Thus, the volume of the container shown in FIG. 2 will be substantially less than the volume of the container shown in FIG. 1. It is to be appreciated, that where the first vessel 22, the second vessel 24, third vessel 32 and fourth vessel 34 each have a perimeter edge 30 which is effectively identical, the sealing ring 26 may be used to connect these vessels in various combinations to achieve various containers with various configurations and volumes. With vessels of two different volumes, the assembled container may have three different volumes and four different variations.

In many of the examples shown below, a pair of vessels are shown of particular volume. Any of the vessels shown may be provided in volume combinations not dictated by the relative volumes or sizes shown. Sets may come in sets with vessels of 2, 3, 4, 5, or more different volumes as desired.

In several examples, the vessels comprise a significant volume, as opposed to well-known planar lids. In one range the vessel pairs may comprise a volume greater than 10%, 25%, 50% or 75% of the attached opposing vessel. In one example where the vessels are substantially identical, the volumes of each vessel are 100% of the volume of the opposing vessel.

For ease in use, the volumes of the vessels disclosed herein may be common to cooking and other activities, such as one cup, pint, quart, gallon, 100 fl oz, liter, half liter, quarter liter, and divisions/combinations thereof.

Figure 3:
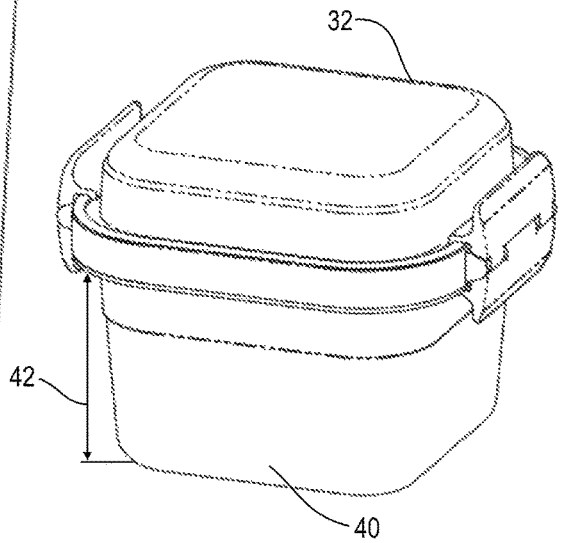
FIG. 3 is a front perspective view of another example of the disclosed storage container.

In some examples of the storage container system 20, the volumes of the vessels forming the container may not be equal. In FIG. 3 is shown one example of a container assembled from the third vessel 32 previously discussed and a fifth vessel 40. The fifth vessel 40 having a depth 42 different than the depth 36 of the third and fourth vessels previously discussed, and having a depth different than the depth 38 of the first vessel 22 and second vessel 24. The container formed by this combination of FIG. 3 would have a volume different than the volumes of the container 28 as shown in FIG. 1, and different than the container shown in FIG. 2. This third vessel, may be combined with other vessels identical to the vessel 40, vessel 32, vessel 22 thus a total of six variations having different volumes are possible with three different vessels of varying depths and cooperating perimeter edges 30.

Each of these vessels of a combination container having perimeter edges 30 which are substantially and functionally identical. Thus, the vessels 22, 24, 32, 34, 40, etc. may be interchanged as desired to form a container 28 or containers having various volumes. In one example, the depth 42 of the fifth vessel 40 may be substantially 25%, 50%, 100%, 200% or a range therebetween relative to the length and/or width of the sealing ring. The fifth vessel 40 also having a perimeter edge which is effectively identical to the perimeter edge 30 of the first, second, third, and fourth vessels may be thereto connected with the sealing ring 26 to form a container (28) of different volume than shown in FIG. 1 or FIG. 2 or FIG. 3. With vessels of two different volumes, the assembled container may be assembled in different combinations comprising six different volumes and multiple different variations.

Figure 4:
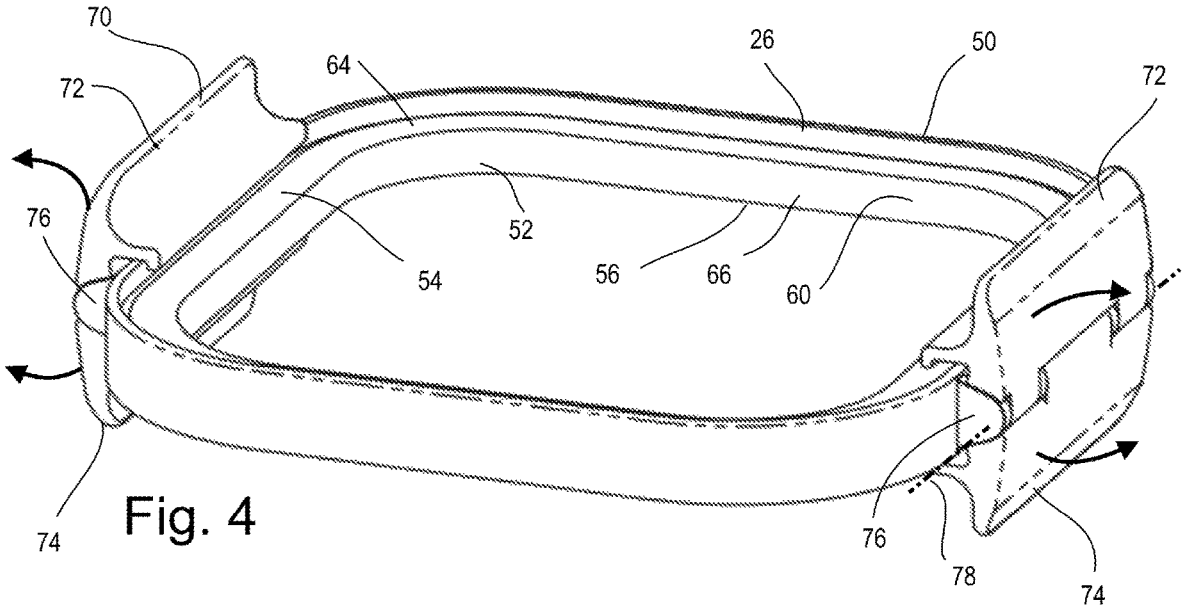
FIG. 4 is a front perspective view of one example of a sealing ring component of the examples of FIG. 1 to FIG. 3.
Figure 5:
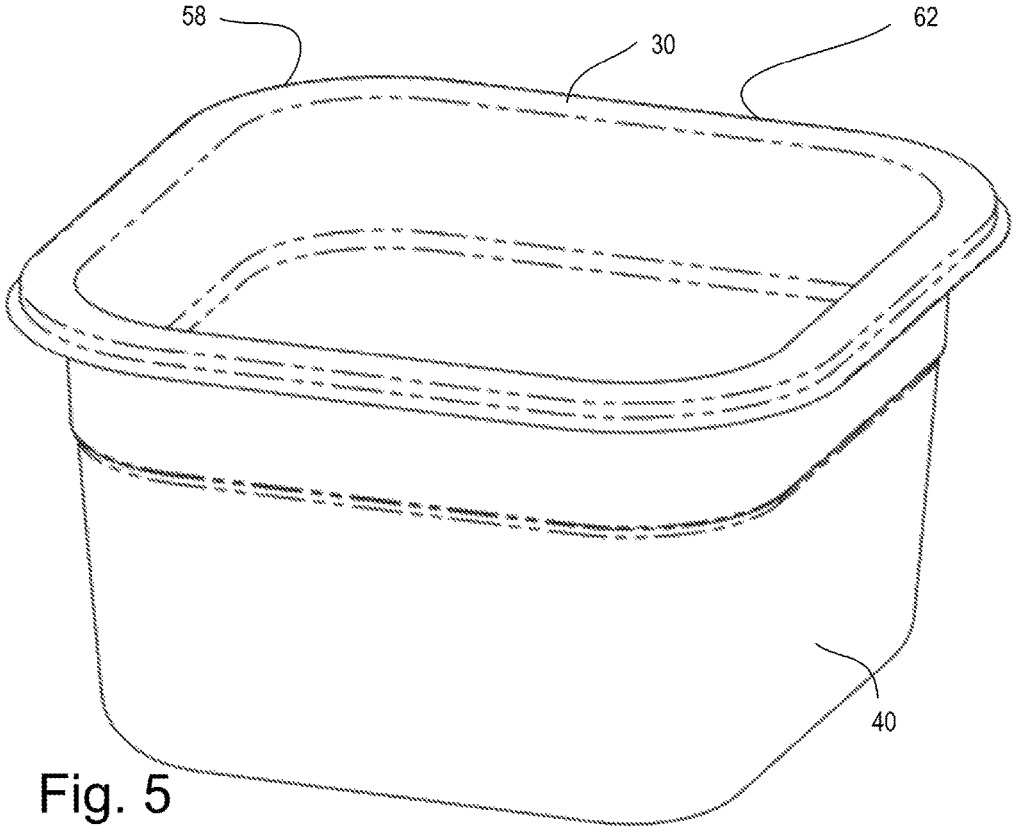
FIG. 5 is a front perspective view of one example of a storage vessel component of the disclosed storage container.

In one example, to ensure that no spillage occurs, to ease in assembly, etc., the sealing ring 26 as shown the example of FIG. 4 comprises a rigid seal frame 50 and one or more seals 52. While FIG. 4 shows a seal formed as a single unitary component without seams, it may alternatively be formed as a plurality of separate components. The term rigid indicating that the frame does not bend under its own weight and generally holds its own shape unless forced, heated, or otherwise deformed. The seal 52 of the sealing ring 26 may be a malleable material made of silicone, rubber, viscous fluid, or equivalent material, or may be a labyrinth seal, a knife seal or other structure configured to keep materials (solid, liquid, gas, or combinations) from passing there past. The seal(s) 52 as shown in these examples comprises opposing contact surfaces 54, 56 on opposing sides thereof to contact the perimeter edge 30 or seal contact surface 58 of a vessel (e.g., vessel 40) as shown in FIG. 5. In one example, the seal 52 is removably fixed to the rigid seal frame 50 by way of adhesives, over molding, or physical connection. In this figure, the inner perimeter edge 60 of the sealing ring 26 is substantially the same shape and dimension as the inner perimeter surface 62 of the vessel 40 adjacent the seal contact surface 58. Thus, the sealing ring does not substantially obstruct passage between the vessels forming the container (28).

Figure 15:
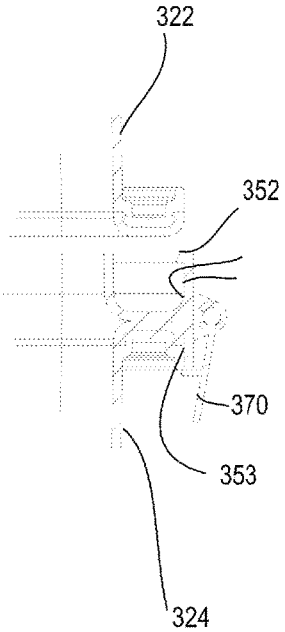
FIG. 15 shows the example of FIG. 14 with the container opened.

In one example, the storage system 20 may be arranged wherein the perimeter seal 52 comprises a first perimeter seal 64 sealed to the first perimeter edge of the first vessel, and a second perimeter seal 66 sealed to the second perimeter edge of the second vessel. This is more easily seen in the example of FIG. 11 or FIG. 15 where similar seals are used with different latching mechanisms.

Figure 8:
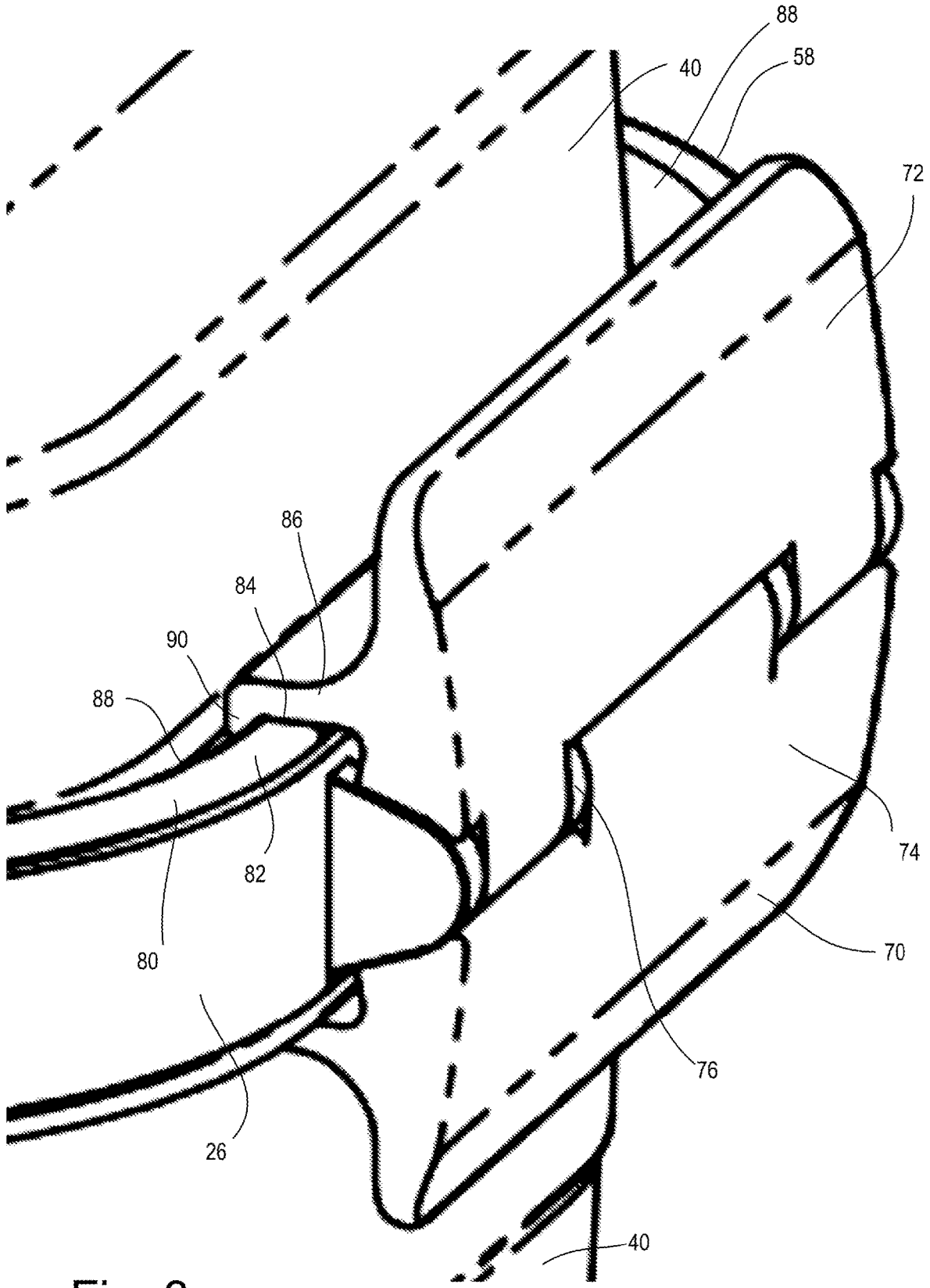
FIG. 8 is an enlarged view of a region of FIG. 1 showing a latch component in greater detail.

While many latching mechanisms may be used to attach the sealing ring 26 to a plurality of vessels 22, 24, 32, 40; one example of such a latching mechanism 70 is shown in FIG. 4/FIG. 8. This example comprising a plurality of rigid user engagement portions 72, 74 which may be attached to the seal frame 50 by way of a hinge 76 having a pivot axis 78 parallel to the adjacent section of the seal frame 50. In one example, the rigid engagement portions 72, 74 may be attached on opposing sides of the seal frame 50. This arrangement allows a latching mechanism on all sides of the vessel if desired. In another example the latching mechanisms may be on adjacent sides, all sides, or a combination of each. These engagement portions 72/74 are pressed by a user to rotate as shown in FIG. 4 about the axis 78 to latch or release the adjacent vessel to the sealing ring 26. In one example, the rigid engagement portions 72, 74 have a large surface area to be pressed upon or pulled by a user to rotate as shown. In one example, the rigid engagement portions 72, 74 have separate hinges and axes 78, in the example shown in FIG. 4/FIG. 8 the rigid engagement portions 72, 74 of a single latch 70 share the same hinge and axis 78. In one example, the hinges 76 are pin and catch, in other examples they are living hinges as shown in FIG. 21.

In another example, the hinges may be placed on one, two, three, four, or more sides of the sealing ring or container.

The hinges may also be living hinges, connecting the latch to the sealing ring. Living hinges are described and shown in other examples.

In the example of FIG. 8, the vessel perimeter edge is shown to include latch contact surfaces 80 including a surface 82 contacting a surface 84 of an extension 86 of the latch 70 and a latch surface 88 substantially orthogonal to the surface 84. The latch surface 88 is engaged by a latch protrusion 90 of the latch 70. In this example, the vessel 40, hinge 76, latch 70 and/or extension 86 are not perfectly rigid, but bend/deform slightly under pressure during latching, these surfaces 88/90 as arranged this way hold the latch 70 in place, exerting pressure on the seals against the perimeter contact surfaces to hold the sealing ring 26 against the perimeter edge 30 and thus create a seal therebetween. Substantial force (e.g., greater than 2 lbs.) may be necessary to so engage and release the surfaces 90 and release the latch 70—from the vessel 40.

Figure 6:
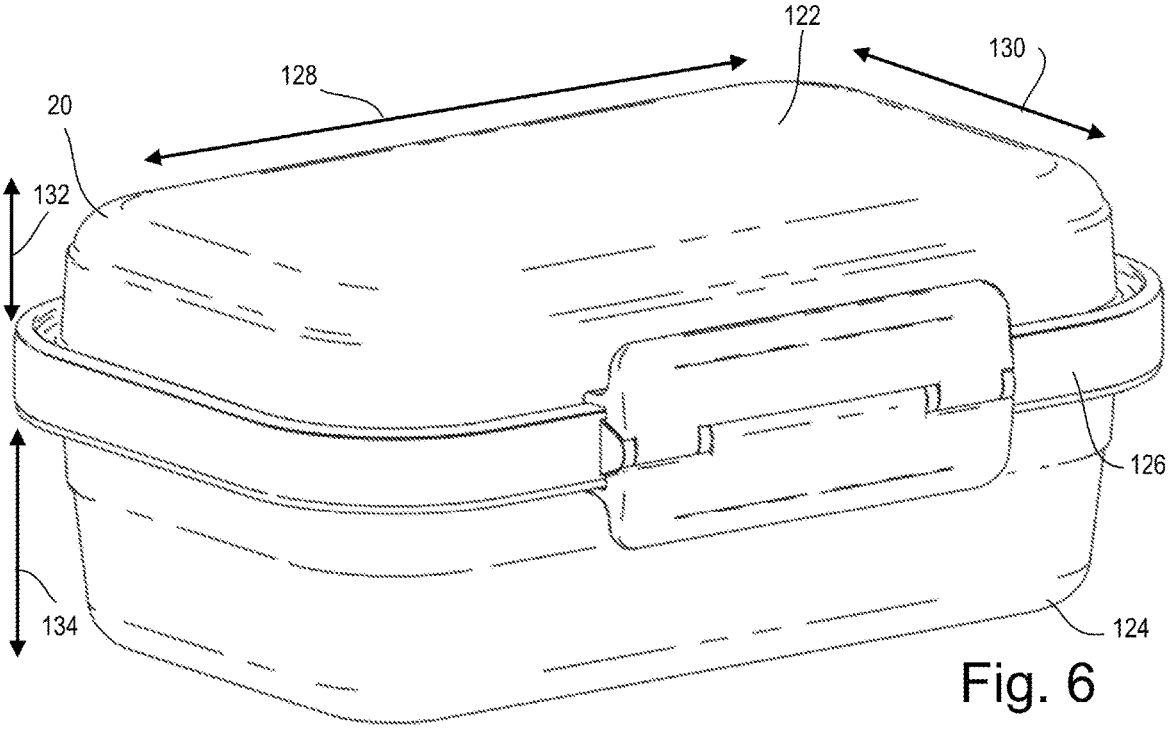
FIG. 6 is another example of the disclosed storage container with a different perimeter edge shape than that shown in FIG. 1 to FIG. 3.
Figure 7:
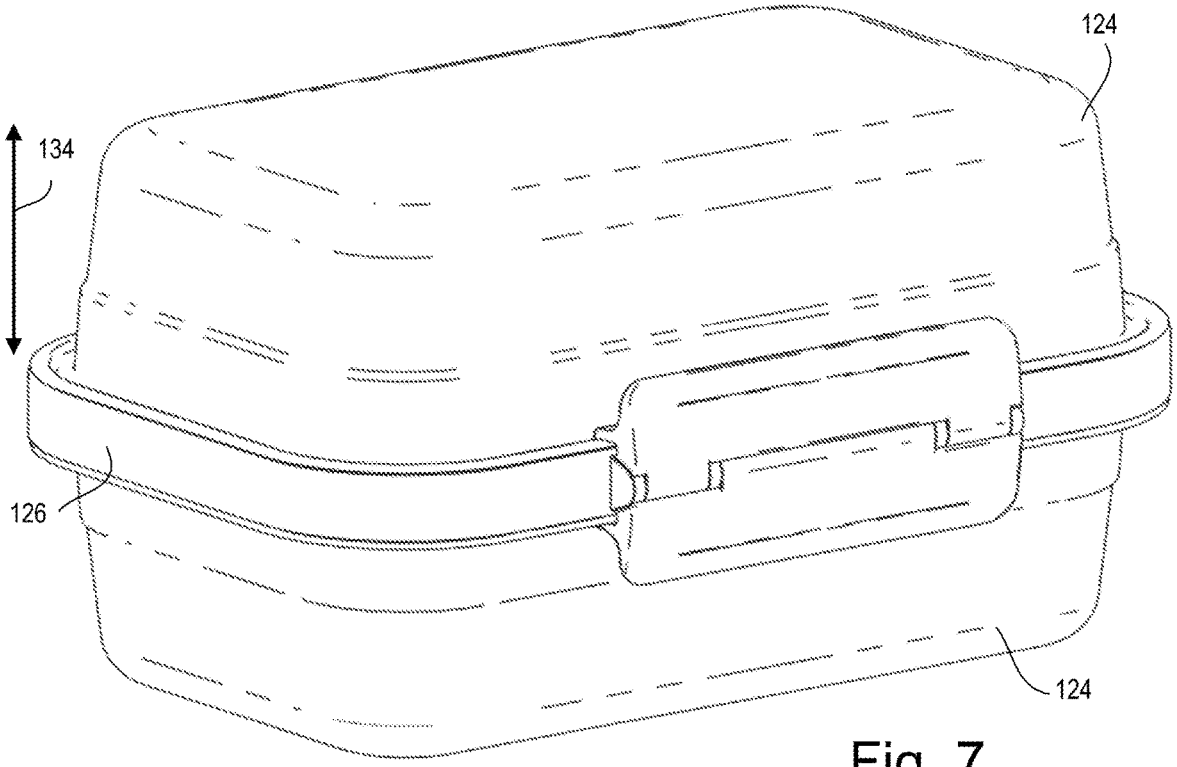
FIG. 7 is another example of the disclosed Storage container.

In the examples of FIG. 1 to FIG. 3 the perimeter edges of the vessels are shown as rounded corner squares, when viewed in plan view. Looking to FIGS. 6 and 7 are shown examples of the storage container system 20 comprising a first storage vessel 122 and a second storage vessel 124 connected by way of a sealing ring 126. Functionally, each of these are similar to those described above. Structurally, these are different in that the longitudinal length 128 of each vessel is substantially different than the transverse width 130 of each vessel. While these examples of FIGS. 6 and 7 may not secure to the vessel of the examples shown in FIG. 1 to FIG. 3 as the perimeter edges are not identical nor are they mirror images of those examples, it can be seen that a first storage vessel 122 of this example may be sealed either to a second storage vessel 124 as shown in FIG. 6 or to another storage vessel as shown in FIG. 7. Provided that the perimeter edges of a plurality (more than one) vessel are identical, mirror images, or rotationally mirrored as in an example that is circular, pentagonal, hexagonal, etc. the vessels will connect and seal to each other when formed as described herein.

Each of the first storage vessels 122 as shown in FIG. 6 may have a depth 132 different than the depth 134 of the second storage vessel 124. Thus, a variety of combinations may be achieved with multiple sizes of vessels as described in previous examples.

The perimeter edges and the vessels themselves may also be other geometric shapes including arcuate shapes. These may include circles, arcs, ovals, stars, pentagon, hexagons, freeform, and combinations thereof.

Figure 9:
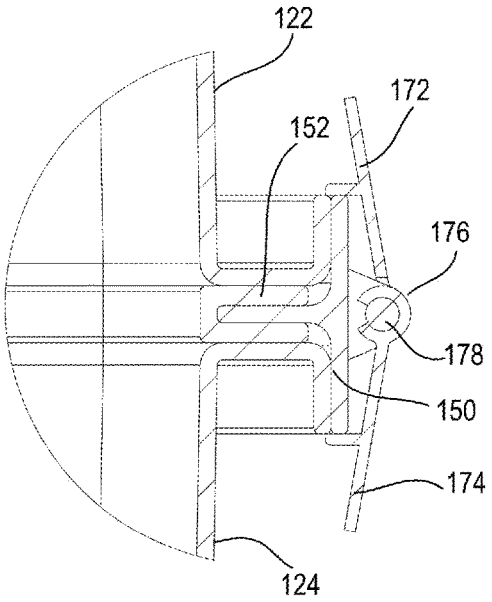
FIG. 9 is a cross-sectional view of one example of the disclosed storage container shown in FIG. 10.
Figure 10:
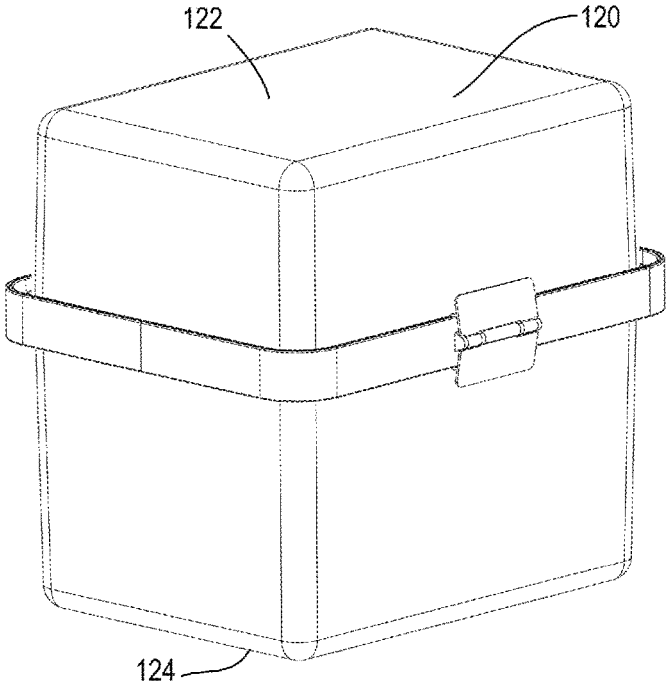
FIG. 10 is another view of the example shown in FIG. 9.

Other examples follow using a numbering system intended to ease in comparison to the previous example(s) where each label includes a first digit (1, 2, 3, etc.) which signifies the example being described and the labels further include digits from the original example with no numeric prefix. For example, the latch component in FIG. 9 is labeled 170, while the latch component in FIG. 8 is labeled 70, without the "1" prefix.

Some examples as previously described use a seal 52 formed as a singular component which may be attached to the seal frame 50. One such example is shown in FIG. 9 where the vessel 122 is connected to the vessel 124 to form a container. A latch 170 is provided mounted to the seal frame 150 substantially as described before A seal frame 150 may be positioned between the vessels with a singular seal 152 attached thereto via a protrusion as shown. When the latch engagement portions 172, 174 are rotated about the axis 178 via hinge 176, the vessels 122, 124 are held in place and the seal 152 is compressed slightly to seal the volume of the container created.

Figure 11:
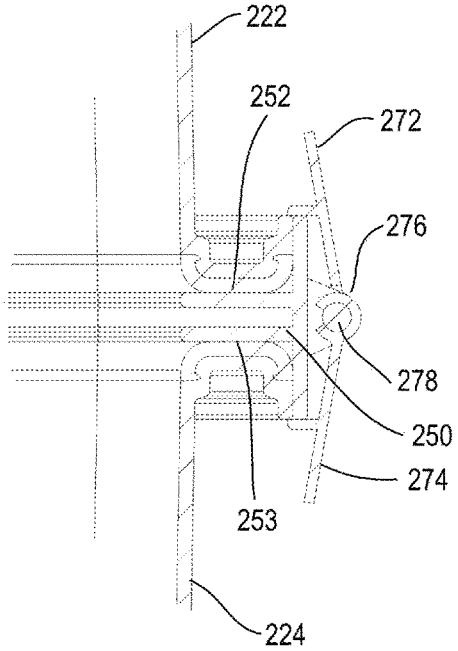
FIG. 11 is a cross-sectional view of one example of the disclosed storage container shown in FIG. 12.
Figure 12:
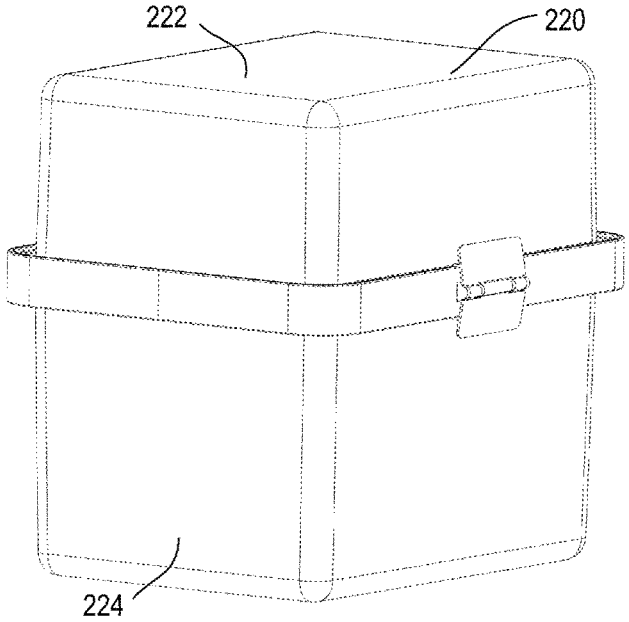
FIG. 12 is another view of the example shown in FIG. 11.
Figure 13:
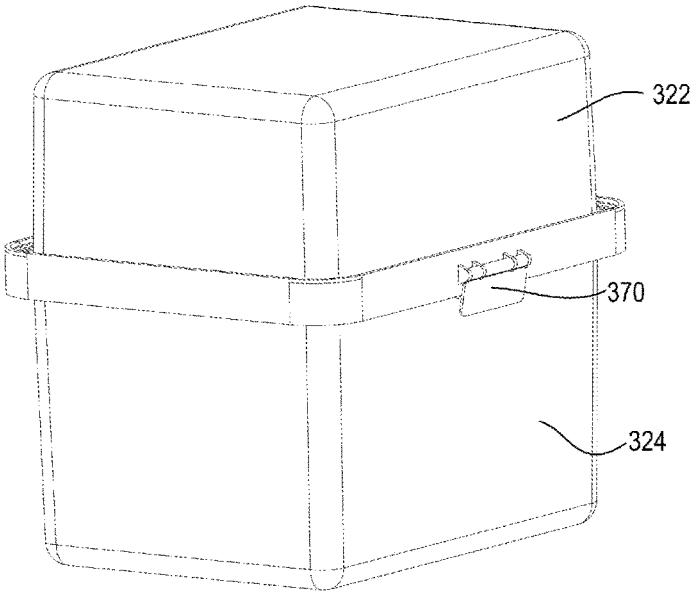
FIG. 13 is another example of the disclosed storage container.
Figure 14:
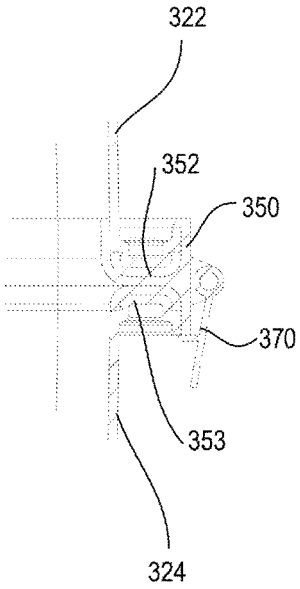
FIG. 14 is a cross-sectional view of the closed container example shown in FIG. 13.

A slightly different example is shown in FIG. 11 where the seal is formed of two separate components 252, 253. The seal portion 252 is attached to the vessel 222, and the seal portion 253 is attached to the vessel 224. These two components of the device sealing to a protrusion of the seal frame 250 positioned therebetween. Thus, when the latch engagement portions 272, 274 are rotated about the axis 278 via hinge 276, the vessels 222, 224 are held in place and the seal components 252, 253 are compressed slightly to seal the volume of the container created. These seals (and other seals disclosed herein) may be removable seals, or seals which cannot be removed easily, or cannot be removed without tools or destruction of either the seal or the component to which they are attached. In one example such non-removable seals may be formed by the process of over molding onto the vessel perimeter edge.

Figure 16:
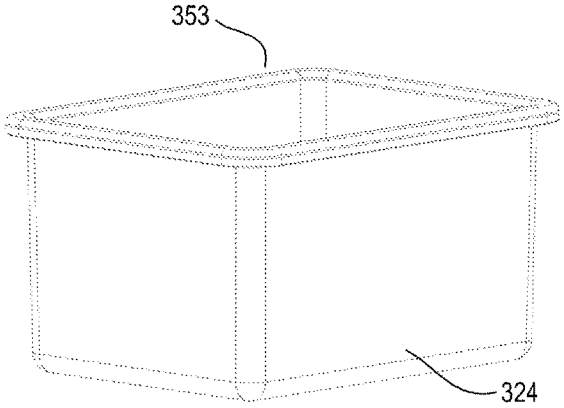
FIG. 16 shows the lower vessel of the example shown in FIG. 13.

Other examples are also shown, including one shown in FIG. 13 to FIG. 16 where the seal frame 350 is attached to the first vessel 322 via a clip mount where the seal frame 350 comprises a seer edge of a u-shaped channel attaches to a conforming edge of the vessel 322. This arrangement removably attaches the seal frame 350 to the first vessel 322. A latch 370 equivalent to that previously described is provided, is attached to the seal frame 350 to removably attach the seal frame 350 to the second vessel 324. In this example, the seal between the vessels 322, 324 is provided by a plurality of seals 352, 353 attached to the vessels or to the seal frame as previously described. Other seals as described herein or known in the art may alternately be used. In FIG. 16 the seal 353 is shown continuing around the perimeter of the vessel 324.

Another example is shown in FIG. 17 through FIG. 19 utilizing a seal ring 450 fits exterior to the first vessel and slides down around a first vessel 422 to engage the outwardly protruding lip thereof. The outwardly protruding lip thus holding the seal ring from movement as the latch 470 is engaged. As with a previous example, seal 452 attached to the first vessel 422 and seal 453 attached to the second vessel 424 provide a seal between the vessels to form the container. In this example, seals 452 and 453 may be in direct contact with each other.

The example shown in FIG. 20 through FIG. 22 utilizes a living hinge 576. Living hinges well known in the art and may be used as shown here where the living hinge 576 and associated latch 570 are formed with the vessel 524. Alternatively, a living hinge may be used in place of one of the previously described hinges as a portion of the seal ring and attached latch.

In the example of FIG. 20 through FIG. 22, each vessel 522, 524 comprises a latch 570 attached by way of a living hinge 576. Where the perimeter edges 530 of each vessel 522, 524 is substantially identical so that when one of the vessels is inverted, the latch 570 of each vessel engages contact surfaces on the opposing vessel. Seal 552, 553 seal the vessels from unwanted spillage or contaminate entry.

In this example, each perimeter edge 530 comprises a raised lip 592 which maintains alignment of the vessels 522, 523 to each other when the raised lip 592 engages a contact surface 593 of the opposing vessel. In the example shown here, the raised lip does not extend more than 50% of the perimeter edge 530 so that each vessel 522, 524 may have the same structure.

Figure 23:
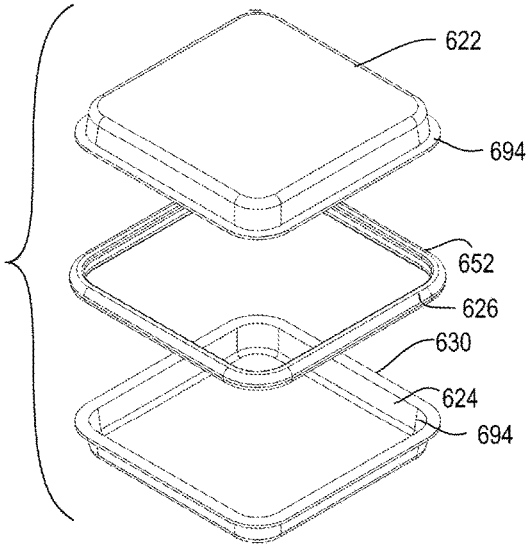
FIG. 23 is an exploded view of another example of the disclosed storage container.
Figure 24:
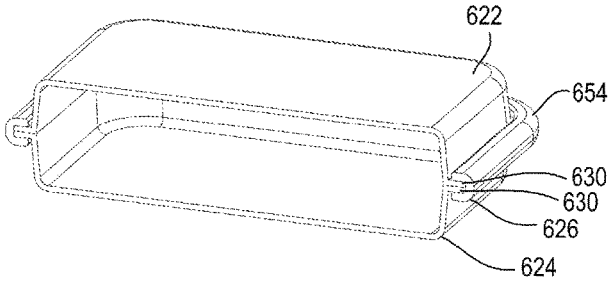
FIG. 24 is a cross-sectional view of the assembled container shown in FIG. 23.

Another example is shown in FIG. 23 to FIG. 24 with a first vessel 622 having a protruding lip 694 on each vessel, and an elastic seal 652 formed of a malleable seal ring 626 which comprises a channel therein to fit around the protruding edges 694. The seal ring 626 thus simultaneously forming a seal 652 between the perimeter edges 630 and holding the vessels 622, 624 in place relative to each other.

Figure 25:
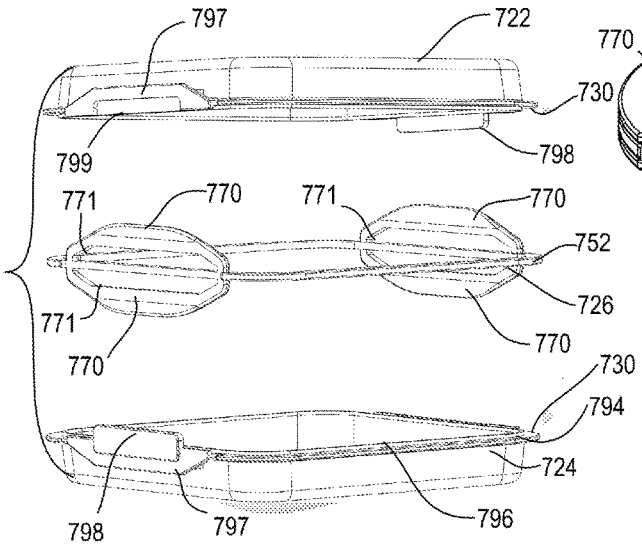
FIG. 25 is an exploded view of another example of the disclosed storage container.
Figure 26:
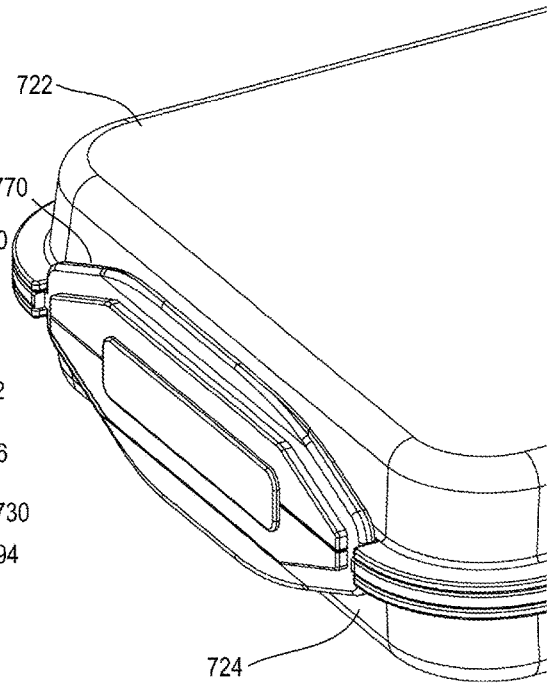
FIG. 26 is an enlarged view of the assembled container shown in FIG. 25.

Looking to FIG. 25, 26 is shown an example similar to that shown in FIG. 23, 24 where the seal ring 726 is positioned between protruding edges 794 of the perimeter edges of the vessels 722, 724. The seal ring 726 thus forming a seal 752 between the vessels when pressure is exerted to compress the seal 752. In this example, latches 770 are formed of the same elastic material as the seal ring 726. These latches 770 forming loops 771 which stretch over a plurality of protrusions 797. These protrusions may be formed on more than one side of the vessels. As shown, the protrusions are on two opposing sides of the vessels. The protrusions may also be on alternating adjacent sides of the vessels.

This example also shows a plurality of alignment protrusions 798 which engage alignment detents or receivers 799 in the opposing vessel receive these protrusions 798 to align the vessels in opposition. By so constructing the perimeter edge 730 with the protrusions 798 and detents 799 as shown, the perimeter edges of this example can be substantially identical and still connect as shown.

Figure 27:
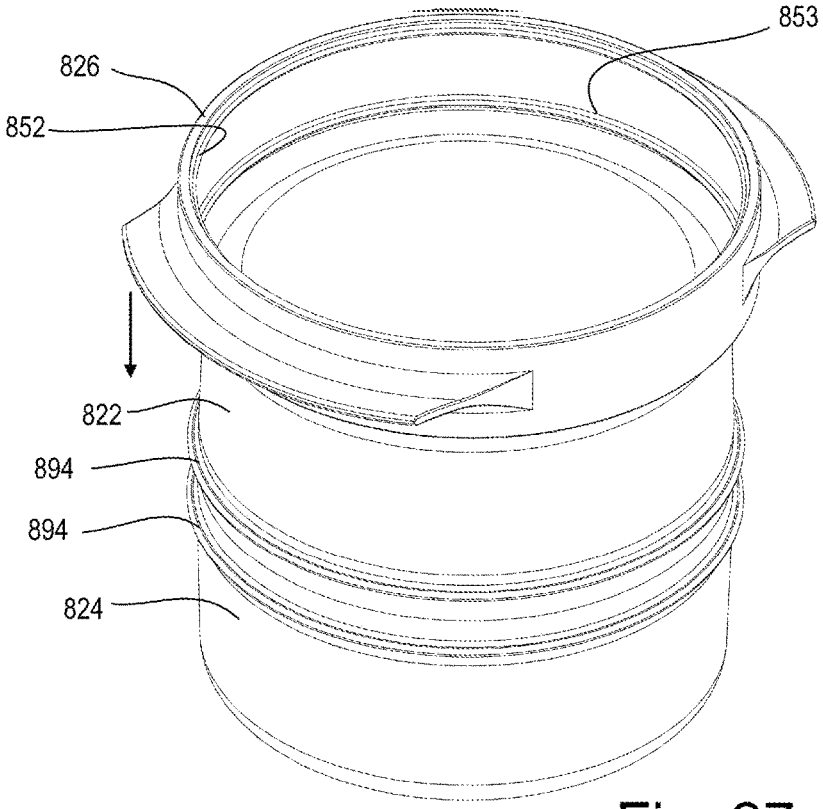
FIG. 27 is a partially assembled view of another example of the disclosed storage container.
Figure 28:
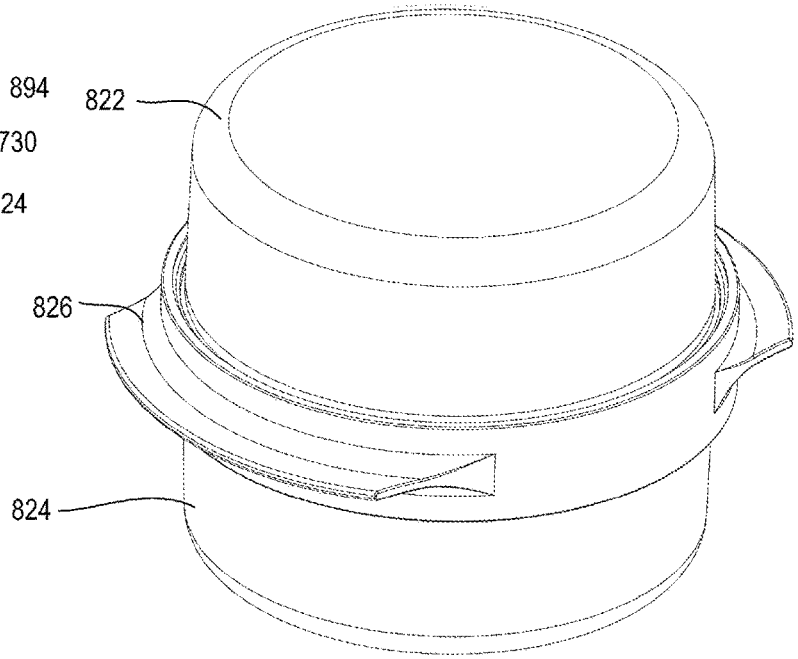
FIG. 28 is an assembled view of the example shown in FIG. 27.

Another example is shown in FIG. 27 to FIG. 28 with the vessels 822, 824 having a circular perimeter edge among other novel features.

Figure 29:
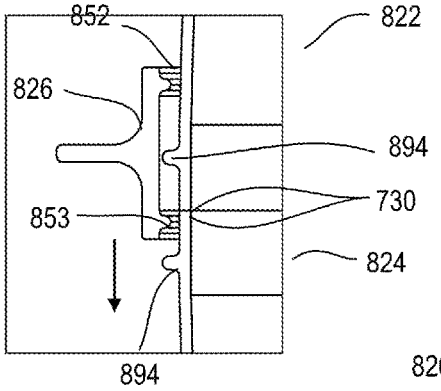
FIG. 29 is a cross-sectional view of a portion of the example shown in FIG. 28.

In this example, functionally similar to the example shown in FIG. 17, FIG. 18, is shown a first vessel 822 connected to a second vessel 824 by way of substantially identical perimeter edges 730 including a protrusion 894 on each perimeter edge offset from the contact surface where the vessels 822, 824 contact each other. The sealing ring 826 slides along the outer surface of either vessel 822, 824 in the direction shown until one of the seals 852, 853 passes both protrusions 894. In this position, the seal ring 826 holds the vessels in place laterally, and seals 852, 854 engage protrusions 894 in compression there between and simultaneously seal the container and hold the vessels 822, 824 in place vertically relative to the orientation shown in FIG. 29.

Another example is depicted in FIGS. 30 through 35 where a first vessel 1022 is connected to a second vessel 1024 via a combination latching mechanism/hinge 1070. Each vessel comprises at least one axis 1078/1079 fixed to the associated vessel. Each of these axes may be substantially a cylindrical rod to which the latching mechanism 1070 is attached.

The latching mechanism 1070 comprises a plurality of clamps 1076, 1077 with a spanning portion therebetween and a user engagement portions 1072 on at least one end.

The connecting element or latching mechanism has 3 major functions: locate, connect & seal. These functions may be integrated in the containers. The seal may be achieved with a malleable seal or other seal design around the perimeter edge.

Aligning the two vessels 1022/1024 may be achieved by locating features in the corners as described in previous examples or other equivalent structures. These features may be asymmetrical, such as provided in alternate corners of a particular vessel instead of each corner of each vessel. They can be part of the seal or part of the container.

Figure 31:
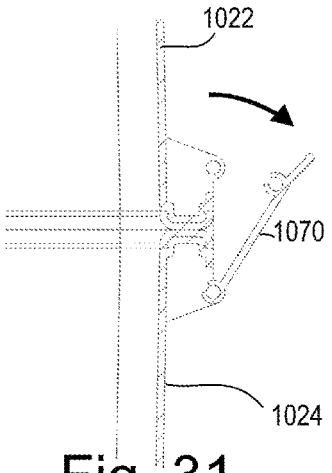
FIG. 31 is a cross-sectional view of the example shown in FIG. 34 with the latch released.
Figure 32:
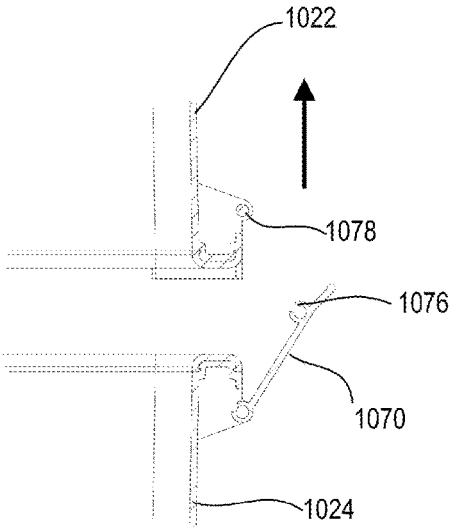
FIG. 32 is a cross-sectional view of the example shown in FIG. 34 with the latch released and the container opened.

Rotating latch mechanisms 1070 as shown in FIG. 31 may be used to lock the first vessel 1022 to the second vessel 1024.

Figure 30:
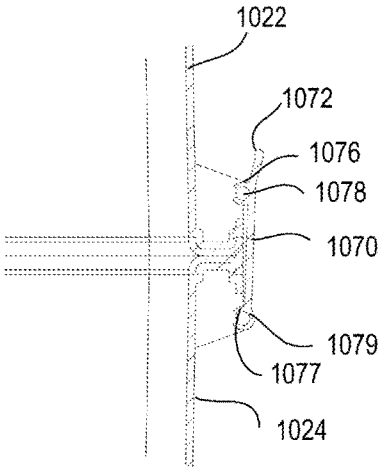
FIG. 30 is a cross-sectional view of the example shown in FIG. 34 with the latch secured.
Figure 34:
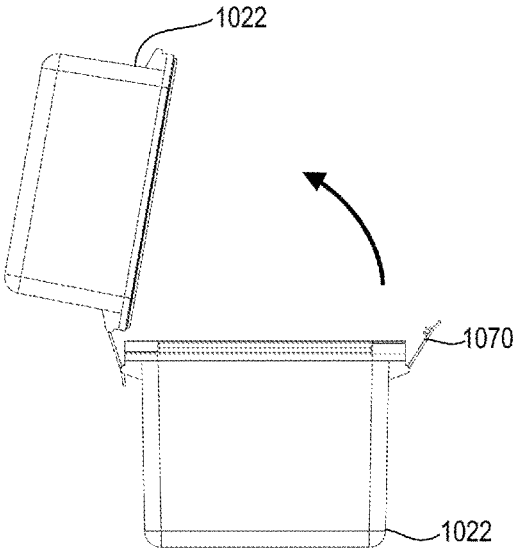
FIG. 34 is another example of the disclosed storage container in a hinged open position.
Figure 33:
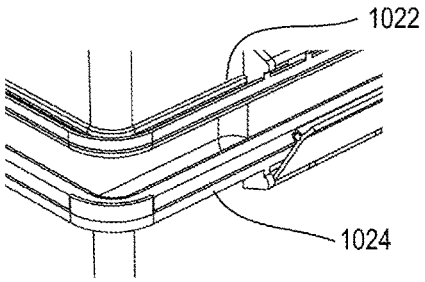
Figure 35:
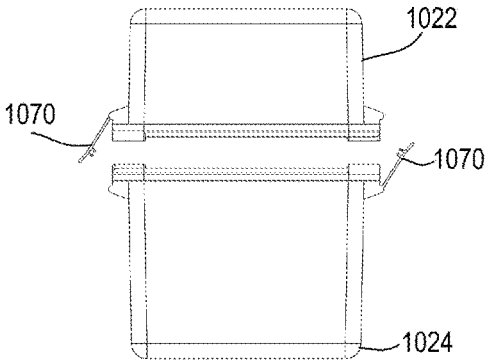
FIG. 35 is another example of the disclosed storage container in an open position.

In the example of FIG. 30, one clamp 1076 is installed on the first vessel 1022 and one clamp 1077 on the second vessel 1024. If only one of the two clamps are released as shown in FIG. 31, 34, the non-released clamp may act as a hinge for the first vessel as shown in FIG. 34. If both are released, the vessels 1022, 1024 can be removed from each other as shown in FIG. 35.

The term "substantially" used in these claims is descriptive to a structure which may allow slight variation, but functionally the same.

While the present invention is illustrated by description of several embodiments and while the illustrative embodiments are described in detail, it is not the intention of the applicants to restrict or in any way limit the scope of the appended claims to such detail. Not all combinations of novel features are shown in all possible combinations, the novel features disclosed herein may be combined in examples not shown. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. A storage container system comprising:

a first vessel having a first perimeter edge defining an opening;

a second vessel having a second perimeter edge defining an opening;

a sealing ring comprising a rigid frame;

the sealing ring having at least one perimeter seal sealed to each of the first perimeter edge and the second perimeter edge;

a latching device provided on transversely opposing sides of the sealing ring, each latching mechanism integral to the sealing ring; each latching device comprising a first latching mechanism, a second latching mechanism;

the first latching mechanism having a first rigid engagement portion attached to the sealing ring by way of a hinge having a pivot axis parallel to an adjacent section of the sealing ring;

the first rigid engagement portion of each first latching mechanism mechanically connecting the first vessel to the sealing ring;

each second latching mechanism having a second rigid engagement portion attached to the sealing ring by way of a second hinge having a pivot axis parallel to an adjacent section of the sealing ring;

the second rigid engagement portion of each second latching mechanism mechanically connecting the second vessel to the sealing ring.

2. The storage container system as recited in claim 1 wherein the first perimeter edge of the first vessel and the second perimeter edge of the second vessel are substantially identical.

3. The storage container system as recited in claim 1 wherein the first perimeter edge of the first vessel and the second perimeter edge of the second vessel are substantially mirror images.

4. The storage container system as recited in claim 1 wherein the sealing ring does not substantially obstruct passage between the first vessel and the second vessel.

5. The storage container system as recited in claim 1 wherein the perimeter seal is removable from the rigid frame.

6. The storage container system as recited in claim 1 wherein the perimeter seal is a malleable seal.

7. The storage container system as recited in claim 1, the perimeter seal comprising:

a first perimeter seal on a first side of the rigid frame, the first perimeter seal in continuous contact with and removably sealed to the first perimeter edge of the first vessel; and a second perimeter seal on a second side of the rigid frame opposing the first side, the second perimeter seal in continuous contact with and removably sealed to the second perimeter edge of the second vessel.

8. A storage container system comprising:

a first vessel having a first perimeter edge defining an opening;

a second vessel having a second perimeter edge defining an opening;

the second vessel having a volume greater than the volume of the first vessel;

a sealing ring having a perimeter seal sealed to each of the first perimeter edge and the second perimeter edge;

a plurality of first latching mechanisms each latching mechanism integral to the sealing ring;

each first latching mechanism provided on transversely opposing sides of the sealing ring;

the latching mechanisms mechanically connecting the first vessel to the sealing ring; and a plurality of second latching mechanisms mechanically connecting the second vessel to the sealing ring.

9. The storage container system as recited in claim 8 wherein the second vessel comprises a volume greater than 25% of the volume of the first vessel.

10. The storage container system as recited in claim 8 wherein the second vessel comprises a volume greater than 50% of the volume of the first vessel.

11. The storage container system as recited in claim 1 wherein the pivot axis of one of the first latching mechanisms is coaxial to the pivot axis of a cooperating second latching mechanism.

12. A storage container system comprising:

a sealing ring comprising a rigid frame;

the sealing ring having a perimeter seal configured to be sealed to each of a first perimeter edge of a first vessel having a first perimeter edge defining an opening, and a second vessel having a second perimeter edge defining an opening second perimeter edge;

a plurality of first latching mechanisms each first latching mechanism integral to the sealing ring, each first latching mechanism having a first rigid engagement portion attached to the sealing ring by way of a hinge having a pivot axis parallel to an adjacent section of the sealing ring;

the first rigid engagement portion configured to mechanically connect the first vessel to the sealing ring;

a plurality of second latching mechanisms each second latching mechanism integral to the sealing ring, each second latching mechanism having a second rigid engagement portion attached to the sealing ring by way of a second hinge having a pivot axis parallel to an adjacent section of the sealing ring;

the second rigid engagement portion configured to mechanically connect the second vessel to the sealing ring; and wherein connection of the first vessel, second vessel to the sealing ring consists of the plurality of the first latching mechanism, the plurality of the second latching mechanism.

13. The storage container system as recited in claim 12 wherein the pivot axis of one of the first latching mechanisms is coaxial to the pivot axis of one of the second latching mechanisms.

14. The storage container system as recited in claim 12 wherein the first perimeter edge of the first vessel and the second perimeter edge of the second vessel are substantially identical.

15. The storage container system as recited in claim 12 wherein the first perimeter edge of the first vessel and the second perimeter edge of the second vessel are substantially mirror images.

16. The storage container system as recited in claim 12 wherein the sealing ring does not substantially obstruct passage between the first vessel and the second vessel.

17. The storage container system as recited in claim 12 wherein the perimeter seal is removable from the rigid frame.

18. The storage container system as recited in claim 12 wherein the perimeter seal is a malleable seal.

19. The storage container system as recited in claim 1 wherein connection of the first vessel, second vessel to the sealing ring consists of the plurality of the first latching mechanism, the plurality of the second latching mechanism.

20. The storage container system as recited in claim 1 wherein connection of the first vessel, second vessel to the sealing ring consists essentially of the plurality of the first latching mechanism, the plurality of the second latching mechanism.

* * * * *